US005810575A

United States Patent [19]

Schwartz et al.

[11] Patent Number: 5,810,575

[45] Date of Patent: Sep. 22, 1998

[54] FLARE APPARATUS AND METHODS

[76] Inventors: Robert E. Schwartz, 4227 E. 52nd Pl.; Lawrence D Berg, 5820 E. 47th Pl., both of Tulsa, Okla. 74135

[21] Appl. No.: 811,580

[22] Filed: Mar. 5, 1997

[51] Int. Cl.[6] ..... F23D 14/00

[52] U.S. Cl. ..... 431/5; 431/202

[58] Field of Search ..... 431/5, 202, 183

[56] References Cited

U.S. PATENT DOCUMENTS

| | | | |
|---|---|---|---|
| 2,802,521 | 8/1957 | Campbell et al. | 158/115 |
| 3,796,209 | 3/1974 | Luft | 126/59.5 |
| 3,822,985 | 7/1974 | Straitz, III | 431/284 |
| 3,893,810 | 7/1975 | Lientz | 23/277 C |
| 3,905,752 | 9/1975 | Miller | 431/183 |
| 3,995,986 | 12/1976 | Straitz | 431/202 |
| 4,003,693 | 1/1977 | Straitz, III | 431/202 |
| 4,323,343 | 4/1982 | Reed et al. | 431/202 |
| 4,353,688 | 10/1982 | Ahner et al. | 432/217 |
| 4,538,982 | 9/1985 | McGill et al. | 431/202 |
| 4,824,361 | 4/1989 | McGill et al. | 431/202 |
| 4,975,042 | 12/1990 | Schwartz et al. | 431/5 |

*Primary Examiner*—Carroll B. Dority
*Attorney, Agent, or Firm*—McAfee & Taft

[57] ABSTRACT

Improved flare apparatus having long service lives for burning flammable gas and air and methods are provided. The flare apparatus is basically comprised of an outer tubular member and an inner tubular member positioned within the outer tubular member whereby an annular flammable gas discharge space is provided immediately adjacent to an annular air discharge space. The flammable gas is discharged into the atmosphere in an annular straight out pattern. At least a portion of the air is discharged into the atmosphere for mixing with the flammable gas in a swirling pattern immediately adjacent to the flammable gas which prevents internal burning and premature failure of the flare apparatus.

40 Claims, 2 Drawing Sheets

FLARE APPARATUS AND METHODS

Background of the Invention

1. Field of the Invention.

The present invention relates generally to improved flare apparatus and methods, and more particularly, to improved flare apparatus and methods for smokelessly flaring flammable gas and air without the occurrence of destructive internal burning.

2. Description of the Prior Art.

Flare apparatus are utilized for burning and disposing of flammable gases. Such apparatus are commonly mounted on flare stacks and located at production, refining, processing plants and the like for disposing of flammable waste gases or other flammable gas streams which are diverted during venting, shut-downs, upsets and/or emergencies.

The flaring of such flammable gases without producing smoke is usually mandatory and has been achieved heretofore by burning the flammable gases with air in the presence of steam. The steam insures that the flammable gas is fully oxidized whereby the production of smoke is prevented.

Smokeless flammable gas flares have also been developed and used which burn the flammable gas in the presence of only air. Smokeless flares which utilize only air require intimate mixing of the flammable gas with the air in order to fully oxidize the gas and prevent smoke. While such flare apparatus utilized heretofore have been successful in eliminating the production of smoke, they generally all have suffered from the disadvantage that they have relatively short service lives. That is, because of internal burning, i.e., the burning of portions of the flammable gas and air within the flare structure, early destruction of the heretofore used flare apparatus has resulted requiring repair or replacement which is expensive and time consuming.

Thus, there is a need for improved flare apparatus and methods of smokelessly burning flammable gas with air whereby the flare apparatus have long service lives.

SUMMARY OF THE INVENTION

Improved flare apparatus for burning flammable gas and air having long service lives, and methods of flaring flammable gas and air in the atmosphere without internal burning and premature failure of the flare apparatus utilized are provided. The improved flare apparatus are basically comprised of an outer tubular member having a discharge end, and at least one inner tubular member positioned within the discharge end portion of the outer tubular member whereby a first annular discharge space is provided between the outer and inner tubular members and a second annular discharge space is provided within the inner tubular member. The first annular discharge space is connected to a source of air or to a source of flammable gas, and the second annular discharge space is connected to the source of air or flammable gas which is not connected to the first discharge space. The annular discharge space to which the source of flammable gas is attached has an annular width in the range of from about 0.25 inch to about 3.5 inches, and means are attached to the annular space to which the source of air is attached to cause at least a portion of the air discharged therefrom to swirl. The swirling of the air prevents it from mixing with the flammable gas in the flare apparatus and burning therein.

The methods of this invention for flaring flammable gas and air without internal burning and premature failure of the flare apparatus utilized basically comprise the steps of discharging the air from the flare apparatus into the atmosphere in an annular pattern whereby at least a portion of the air is swirled, and discharging the flammable gas from the flare apparatus into the atmosphere in an annular straight out pattern immediately adjacent to the swirled portion of the discharged air whereby the air mixes with the flammable gas and the mixture is burned outside of the flare apparatus.

It is, therefore, a general object of the present invention to provide improved flare apparatus and methods.

A further object of the present invention is the provision of improved flare apparatus and methods of smokelessly flaring flammable gas and air without internal burning and premature failure of the flare apparatus.

Other and further objects, features and advantages of the present invention will be readily apparent to those skilled in the art upon a reading of the description of preferred embodiments which follows when taken in conjunction with the accompanying drawings.

BRIEF DESCRIPTION OF THE DRAWINGS

FIG. 6 is a cross-sectional view taken along line 6—6 of FIG. 5.

DESCRIPTION OF PREFERRED EMBODIMENTS

Figure 1:
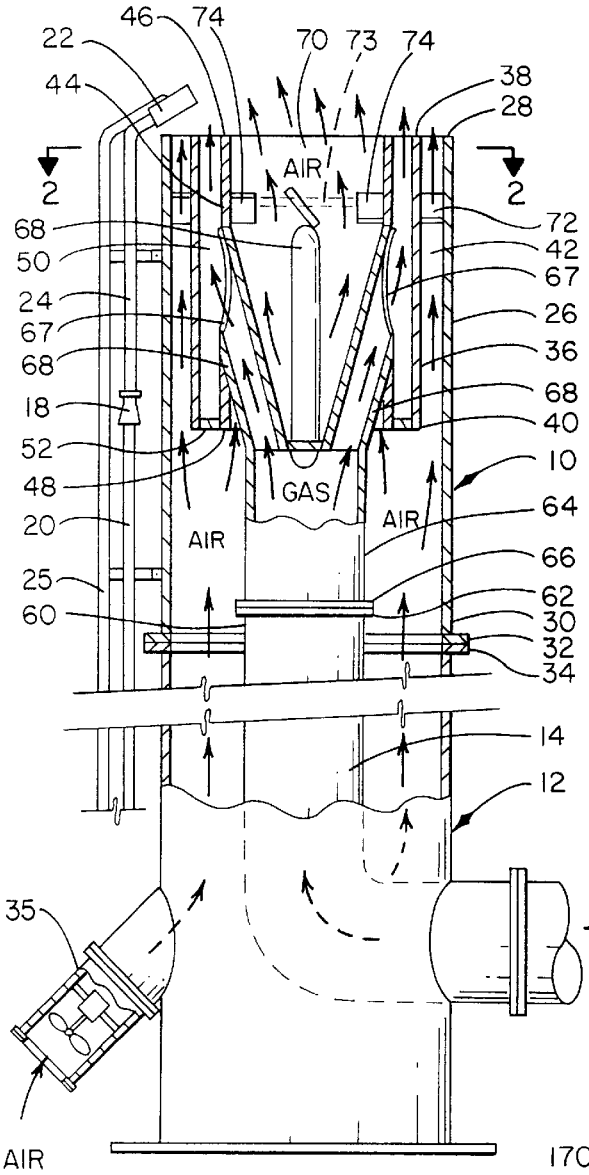
FIG. 1 is a side, partially cross-sectional view of a presently preferred embodiment of the improved flare apparatus of the present invention mounted on a flare stack.
Figure 2:
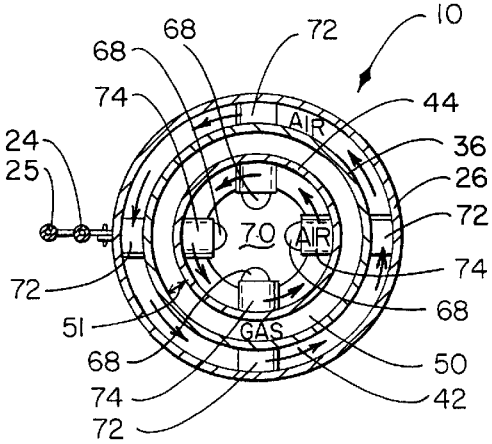
FIG. 2 is a cross-sectional view taken along line 2—2 of FIG. 1.

Referring now to the drawings, and particularly to FIGS. 1 and 2, an improved flare apparatus of the present invention is illustrated and generally designated by the numeral 10. In FIG. 1, the flare apparatus 10 is shown sealingly connected to the top end of a flare stack 12 and to a flammable gas conduit 14 which extends through the flare stack 12 for conducting a stream of flammable gas to the flare apparatus 10. Pilot fuel gas is conducted to a conventional gas-air mixer 18 by a conduit 20 attached to the flare apparatus 10, and the fuel and air mixture produced in the mixer 18 is conducted to a pilot burner 22 by a conduit 24 attached to the flare apparatus 10. A pilot ignitor (not shown) is connected to a conduit 25 attached to the flare apparatus 10 for generating an ignition flame which is conducted to the pilot burner 22 by the conduit 25. While only one pilot burner-ignitor assembly is illustrated in the drawings, it will be understood by those skilled in the art that two or more of such assemblies can be utilized depending on the quantity of gas to be flared and other factors.

The flare apparatus 10 is comprised of an outer tubular member 26 having a discharge end 28 and an inlet end 30. A conventional flange 32 is sealingly attached to the inlet end 30 of the tubular member 26 for connecting the flare apparatus 10 to a complimentary flange 34 sealingly attached to the top end of the flare stack 12. A combustion air blower 35 is connected to the flare stack 12 and the air flow produced by the blower 35 travels upwardly through the flare stack 12 and into and through the flare apparatus 10 as will be described further hereinbelow.

A first inner tubular member 36 having a discharge end 38 and an opposite end 40 is positioned within at least the upper discharge end portion of the outer tubular member 26. The first inner tubular member 36 forms an annular air discharge space 42 between it and the outer tubular member 26.

A second inner tubular member 44 having a discharge end 46 and an opposite end 48 is positioned within the first inner tubular member 36. The second inner tubular member 44 forms an annular flammable gas discharge space 50 between it and the first inner tubular member 36. The flammable gas discharge space 50 is closed at the opposite ends of the first and second inner tubular members 36 and 44 by an annular plate 52 attached thereto.

The top end 60 of the flammable gas conduit 14 disposed within the flare stack 12 has a flange 62 sealingly attached thereto. A conduit 64 having a flange 66 sealingly attached thereto is connected to the conduit 14 by the connection comprised of the flanges 62 and 66. The conduit 64 is a part of the flare apparatus 10, and its upper end terminates in four identical conduits 68 which are sealingly connected in spaced relationship to the conduit 64. As best shown in FIG. 1, the opposite ends of the conduits 68 are sealingly connected to spaced openings 67 in the tubular member 44. Thus, the flammable gas which flows through the conduit 14 within the flare stack 12 and through the conduit 64 and conduits 68 of the flare apparatus 10 flows into the flammable gas discharge space 50 between the first and second inner tubular members 36 and 44. The flammable gas is discharged from the flammable gas discharge space 50 of the flare apparatus 10 in an annular straight out pattern. The term "annular straight out pattern" is used herein to mean that the flammable gas is discharged from the annular flammable gas discharge space 50 in a direction generally parallel to the longitudinal axis of the flare apparatus 10.

The interior space 70 of the second inner tubular member 44 is also utilized as an annular air discharge space as illustrated by the arrows in FIG. 1. Generally, it is preferred to utilize the space 70 for discharging air so that air is discharged on both sides of the discharged flammable gas. However, in some applications the space 70 can be sealed or partially sealed at the top or bottom thereof whereby air flowing into and through the outer tubular member 26 is prevented from flowing through the space 70 or is caused to flow through a restricted part of the space 70, e.g., an annular part adjacent the flammable gas discharge space 50. This can, for example, be accomplished by attaching a centrally positioned circular plate 73 interiorly of the deflectors 74 as shown in dashed lines in FIG. 2. Alternatively, the annular air discharge space 42 can be eliminated and all of the air caused to flow through all or a part of the space 70. The term "annular discharge space" is used herein to include the annularly shaped discharge spaces of the flare apparatus disclosed as well as the centrally positioned circular discharge space which functions in a similar way as an annular discharge space.

Disposed within the annular air discharge space 42 and the annular air discharge space 70 are pluralities of air deflectors 72 and 74 (four are shown in each space). The deflectors 72 and 74 can be fixed or adjustable slanted vanes attached in spaced relationship within the annular air discharge space 42 and the annular air discharge space 70, respectively. The deflectors 72 and 74 cause the air discharged from the air discharge spaces 42 and 70 to swirl thereby unexpectedly preventing the discharged air as well as ambient air from ingressing into and mixing with flammable gas inside the flare apparatus 10, e.g., the flammable gas discharge space 50, and burning therein which causes the metal forming the flare parts to quickly deteriorate. The deflectors 74 in the circular space 70 are positioned adjacent to the flammable gas discharge space 50 so that at least the portion of the discharged air immediately adjacent to the flammable gas discharged from the space 50 is swirled. The effective annular width of the swirling air discharged from the circular space 70 is generally at least equal to the width of the deflectors 74 therein.

In order to obtain smokeless burning of the flammable gas and air discharged from the flare apparatus 10, the cross-sectional areas of the annular air discharge spaces 42 and 70 are sized so that the velocities of the air discharged from the flare apparatus 10 are relatively high. That is, the annular air discharge space 42 preferably has a cross-sectional area such that the air discharged therefrom has a velocity in the range of from about 90 to about 250 feet per second. The cross-sectional area of the circular air discharge space 70 may be sized, such as by including the previously described circular baffle 73 or the like therein to partially block the space 70 whereby the air discharged therefrom has a velocity in the range of from about 90 to about 250 feet per second.

Also, it has been found that in order to obtain thorough mixing of the flammable gas with discharged air and ambient air, the annular width 51 (See FIG. 2) of the flammable gas discharge space 50 must be within the range of from about 0.25 inch to about 3.5 inches depending on the flammable gas pressure and hydrogen to carbon ratio. Generally, the width of the flammable gas discharge space must be smaller as the flammable gas pressure increases, and such width must be smaller as the hydrogen to carbon ratio of the flammable gas decreases. Further, the ratio of the effective annular width of any air discharge space adjacent to the flammable gas discharge space to the annular width of the flammable gas discharge space must be in the range of from about 1 to about 10, preferably from about 1 to about 4. While the ratio can be greater than 10, the cost of operating the flare becomes higher at ratios above about 4.

Figure 3:
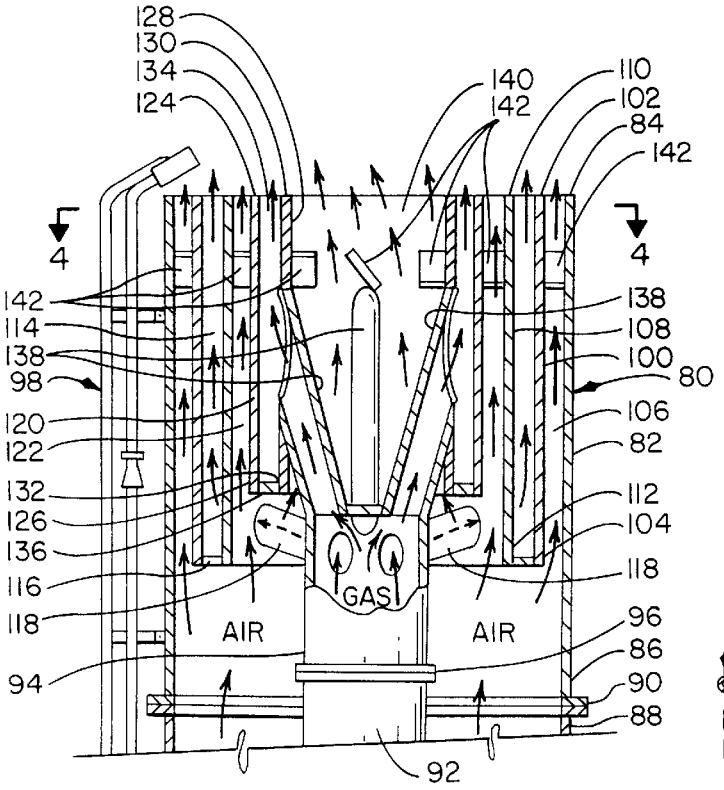
FIG. 3 is a side, partly cross-sectional view of an alternate embodiment of flare apparatus of the present invention.
Figure 5:
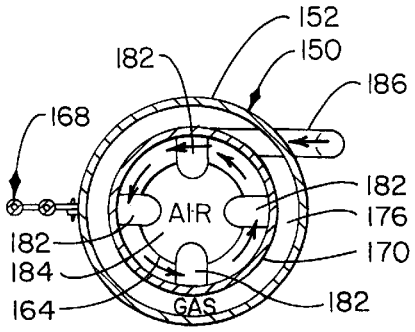
Figure 4:
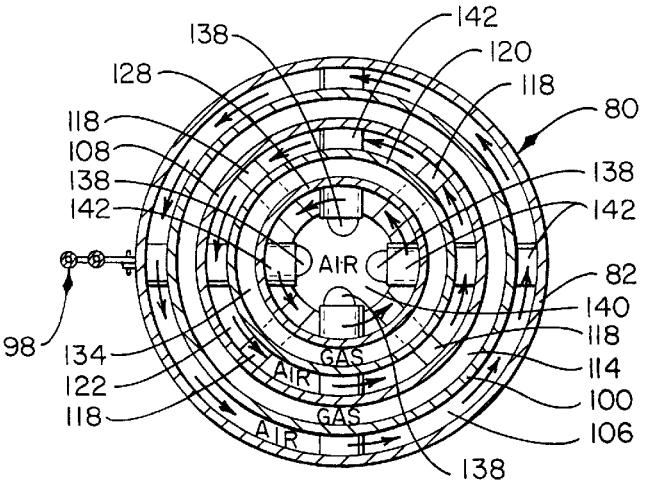
FIG. 4 is a cross-sectional view taken along line 4—4 of FIG. 1.

Referring now to FIGS. 3 and 4, an alternate embodiment of the flare apparatus of the present invention is illustrated and generally designated by the numeral 80. The flare apparatus 80 is similar to the previously described flare apparatus 10 except that it includes at least two additional tubular members positioned within the outer tubular member which are spaced from each other and from the other tubular members whereby at least one additional annular flammable gas discharge space and one additional annular air discharge space are provided therein. More specifically, the flare apparatus 80 includes an outer tubular member 82 having a discharge end 84 and an inlet end 86. Like the apparatus 10, the outer tubular member 82 can be attached to a flare stack 88 by means of a flanged connection 90. Also, a flammable gas conduit 92 is attached to a complimentary flammable gas conduit 94 which is a part of the flare apparatus 80 by a flange connection 96. One or more pilot burner and ignitor assemblies generally designated by the numeral 98 are attached to the outer tubular member 82, and air flows into the outer tubular member 82 from the flare stack 88 or other source.

A first inner tubular member 100 having a discharge end 102 and an opposite end 104 is disposed within the discharge end portion of the outer tubular member 82 whereby an annular air discharge space 106 is provided between the outer tubular member 82 and first inner tubular member 100. A second inner tubular member 108 is positioned within the first inner tubular member having a discharge end 110 and an opposite end 112. The first and second inner tubular members 100 and 108 define an annular flammable gas discharge space 114 which is closed at the ends 104 and 112 thereof by an annular plate 116. The annular flammable gas discharge space 114 is connected to the flammable gas conduit 94 by four spaced conduits 118 sealingly connected therebetween. Disposed within the second inner tubular member 108 is a third inner tubular member 120 which defines a second annular air discharge space 122 between it and the second inner tubular member 108. The third inner tubular member 120 has a discharge end 124 and an opposite end 126, and a fourth inner tubular member 128 is disposed within the third inner tubular member having a discharge end 130 and an opposite end 132. The third inner tubular member 120 and fourth inner tubular member 128 define a second annular flammable gas discharge space 134, and the bottom of the space 134 is closed by an annular plate 136. Four spaced conduits 138 are sealingly connected between the second annular flammable gas discharge space 134 and the flammable gas conduit 94 for conducting flammable gas to the discharge space 134.

Thus, the flare apparatus 82 has a first annular air discharge space 106 for discharging a first part of the air in an annular swirling pattern wherein at least a portion of the first part of the air is swirled. Positioned immediately adjacent the first annular air discharge space 106 is a first annular flammable gas discharge space 114 for discharging a first part of the flammable gas in an annular straight out pattern. Positioned adjacent to the annular flammable gas discharge space 114 is a second annular air discharge space 122 for discharging a second part of the air in an annular swirling pattern wherein at least a portion of the second part of the air is swirled, and positioned adjacent the annular space 122 is a second flammable gas discharge space 134 for discharging a second part of the flammable gas in an annular straight out pattern. Like the flare apparatus 10, the flare apparatus 80 can also optionally include a central air discharge space 140 within the fourth inner tubular member 128 which forms an annular discharge space for discharging a third part of the air in an annular swirling pattern wherein at least a portion of the third part of the air is swirled. The flare apparatus 80 includes a plurality of air deflectors 142, attached within the air discharge spaces 106, 122 and 140 which cause the parts of the air discharged from the spaces 106, 122 and 140 to swirl immediately adjacent to the flammable gas discharge spaces 114 and 134.

OPERATION OF THE FLARE APPARATUS 10 AND 80

In the operation of the apparatus 10, a stream of air produced by the air blower 35 flows through the flare stack 12 and into and through the flare apparatus 10. That is, the air flows into the annular air discharge spaces 42 and 70, and is deflected by the vanes 72 and 74 attached therewithin. As a result, first and second parts of the air are discharged from the spaces 42 and 70, respectively, in annular swirling patterns. That is, at least the portions of the first and second parts of the air immediately adjacent to the discharged flammable gas are swirled. Further, when the annular air discharge space 70 is not utilized, only the portion of the air discharged from the annular discharge space 42 adjacent to the discharged flammable gas must be swirled. However, it is generally preferable that all of the air discharged from the space 42 is swirled.

Flammable gas to be flared flows through the conduit 14, the conduit 64 and the conduits 68 into the annular flammable gas discharge space 50. Because the space 50 does not include deflectors, the flammable gas is discharged from the flare apparatus 10 in an annular straight out pattern. The discharged air and flammable gas mix together and with atmospheric air adjacent to the flare 10 and are burned in the atmosphere without smoke. Because the air is swirled as described above prior to when it is discharged from the flare apparatus 10, air is not pulled into or otherwise caused to ingress into the interior of the flare apparatus 10, mix with flammable gas and burn therein as is often the case with prior art flare apparatus. As mentioned, in certain applications the central air discharge space 70 may be blocked and not utilized or partially blocked. As also mentioned, the annular width of the annular flammable gas discharge space must be within the range of from 0.25 inch to 3.5 inches and the ratio of the effective annular width of each of the air discharge spaces to the annular width of the flammable gas discharge space should be within the range of from about 1 to about 10, preferably from about 1 to 4.

The operation of the flare apparatus 80 is the same as the operation of the apparatus 10 described above except that flammable gas is discharged in two parts, i.e., from the annular flammable gas discharge spaces 114 and 134, in annular straight out patterns with the air being discharged in two or three parts from the annular discharge spaces 106 and 122 or from the annular discharge spaces 106, 122 and 140 in annular patterns whereby at least portions of the air adjacent to the flammable gas discharge spaces are swirled. The above mentioned air discharge spaces are located immediately adjacent to the flammable gas discharge spaces 114 and 134 whereby the discharged flammable gas is immediately adjacent to swirling air and is intimately mixed therewith as well as with some atmospheric air and burned in the atmosphere. While it is preferable to swirl at least portions of the discharged air on both sides of each of the discharged first and second parts of the flammable gas, it is only necessary that a swirling portion of the air be discharged immediately adjacent one side of each of the discharged parts of the flammable gas to prevent internal burning. Thus, at least portions of one or more of the discharged first, second or third parts of the discharged air should be discharged in annular swirling patterns immediately adjacent to at least one side of each of the discharged first and second parts of flammable gas.

The annular widths of the flammable gas discharge spaces 114 and 134 must be in the range of from about 0.25 inch to about 3.5 inches and the ratio of effective annular width of each of the air discharge spaces to the annular width of each of the flammable gas discharge spaces should be within the range of from about 1 to about 10, preferably from about 1 to about 4.

As previously mentioned, the velocities of the air portions discharged from the air discharge spaces are relatively high, i.e., in the range of from about 90 to about 250 feet per second, to insure sufficient mixing for smokeless burning.

The methods of the present invention for burning a mixture of flammable gas and air without internal burning and premature failure of the flare apparatus utilized comprise the following steps. Flammable gas is discharged from the flare apparatus into the atmosphere in one or more annular straight out patterns. The air is discharged from the flare apparatus into the atmosphere in one or more annular patterns whereby at least the portion or portions of the air immediately adjacent to the discharged flammable gas is swirled. The air mixes with the flammable gas and the mixture is burned outside of the flare apparatus. That is, because the air is discharged in an annular swirling pattern adjacent the flammable gas, the air is not pulled into the apparatus mixed with gas and burned therein as commonly occurs in the heretofore utilized smokeless flammable gas air only flare apparatus.

Figure 5:
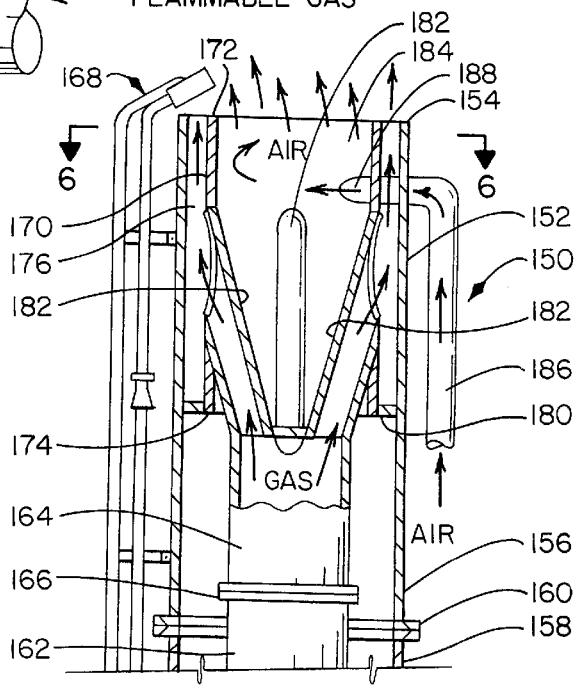
FIG. 5 is a side, partly cross-sectional view of yet another embodiment of the flare apparatus of this invention.

Referring now to FIGS. 5 and 6, another alternate embodiment of the flare apparatus of the present invention is illustrated and generally designated by the numeral 150. The flare apparatus 150 is similar to the previously described flare apparatus 10 and 80 except that it includes a single annular flammable gas discharge space and an annular air discharge space immediately adjacent the interior of the flammable gas discharge space. That is, the flare apparatus 150 includes an outer tubular member 152 having a discharge end 154 and an inlet end 156. Like the previously described apparatus 10 and 80, the outer tubular member 152 can be attached to a flare stack 158 by a flanged connection 160. Also, a flammable gas conduit 162 is attached to a complimentary flammable gas conduit 164 which is a part of the flare apparatus 150 by a flanged connection 166. One or more pilot burner and ignitor assemblies 168 are attached to the outer tubular member 152.

A first inner tubular member 170 having a discharge end 172 and an opposite end 174 is disposed within the discharge end portion of the outer tubular member 152 whereby an annular flammable gas discharge space 176 is provided between the outer tubular member 152 and the inner tubular member 170. The flammable gas discharge space 176 is closed by an annular plate 180 attached to the opposite end 174 of the inner tubular member 170 and to the outer tubular member 152. The flammable gas discharge space 176 is sealingly connected to the flammable gas conduit 164 by four spaced conduits 182. The inner tubular member 170 also defines a circular air discharge space 184. Instead of air being pumped into the flare stack 158 and through the flare apparatus 150 as in the previously described flare apparatus, a source of atmospheric air such as an air blower (not shown) is connected by a conduit 186 to an opening 188 in the inner tubular member 170. As best shown in FIG. 6, the conduit 186 is connected to the upper portion of the tubular member 170 tangentially so that the air is caused to swirl within the air discharge space 184 and is discharged therefrom in an annular swirling pattern immediately adjacent the flammable gas discharged from the annular flammable gas discharge space 176 in an annular straight out pattern.

Thus, the flare apparatus 150 has an annular discharge space 176 for discharging flammable gas in an annular straight out pattern and an air discharge space 184 for discharging air immediately adjacent the discharged flammable gas in an annular swirling pattern. Like the previously described flare apparatus 10 and 80, in order to obtain thorough mixing of the flammable gas with discharged and ambient air, the annular width of the flammable gas discharge space 176 must be within the range of from about 0.25 inch to about 3.5 inches depending on the flammable gas pressure and hydrogen to carbon ratio. Further, the ratio of the total effective annular width of the discharged air adjacent the discharged flammable gas to the annular width of the discharged flammable gas should be in the range of from about 1 to about 4.

OPERATION OF THE FLARE APPARATUS 150

The operation of the flare apparatus 150 is the same as the operation of the apparatus 10 and 80 described above except that the flammable gas is discharged from an annular flammable gas discharge space 176 in an annular straight out pattern and the air is discharged from the air discharge space 184 located on the inside of the annular discharge space 176 in an annular swirling pattern. Instead of utilizing deflectors to cause the air to swirl, the flare apparatus 150 introduces air into the air discharge space 184 tangentially whereby it is swirled therein prior to being discharged.

In order to further illustrate the flare apparatus and methods of the present invention, the following example is given.

EXAMPLE

The flare apparatus 10 is utilized to smokelessly flare 345,600 standard cubic feet per hour of propane gas. The diameter of the outer tubular member 26 is 38 inches and the diameter of the first inner tubular member 36 is 30 inches whereby the annular air discharge space 42 has an annular width of 4 inches. Air at a rate of 30,300 standard cubic feet per minute is discharged from the air discharge space 42 in an annular swirling pattern at a velocity of about 170 feet per second.

The diameter of the second inner tubular member 44 is 24 inches thereby forming an annular flammable gas discharge space 50 having an annular width of 3 inches. The propane gas is discharged from the space 50 in an annular straight out pattern.

Additional air is discharged through the central air discharge space 70 within the tubular member 44 at a rate of 32,000 standard cubic feet per minute in a swirling pattern. The air discharge space 70 has a diameter of 24 inches, and is discharged at a velocity of about 170 feet per second. The ratio of the effective annular width of the outer air discharge space (4 inches) to the annular width of the flammable gas discharge space (3 inches) is 1.33. The ratio of the effective annular width of the central annular air discharge space (12 inches or less) to the flammable gas discharge space is about 4.

The flammable gas and air are smokelessly burned in the atmosphere adjacent the discharge end of the flare apparatus 10 without internal burning within the flare apparatus 10 taking place.

Thus, the present invention is well adapted to carry out the objects and advantages mentioned as well as those which are inherent therein. While numerous changes may be made by those skilled in the art, such changes are encompassed within the spirit of this invention as defined by the appended claims.

What is claimed is:

1. An improved flare apparatus having a long service life for discharging and burning a flammable gas and air in the atmosphere comprising:

an outer tubular member having a discharge end;

at least one inner tubular member positioned within the discharge end portion of said outer tubular member whereby an annular flammable gas discharge space is provided between said outer tubular member and said inner tubular member and an air discharge space is provided within said inner tubular member;

said flammable gas discharge space between said outer tubular member and said inner tubular member having an annular width in the range of from about 0.25 inch to about 3.5 inches and being connected to a source of flammable gas;

said air discharge space within said inner tubular member being connected to a source of air; and means attached to said air discharge space for causing air discharged from said air discharge space to swirl thereby preventing said air from mixing with said flammable gas inside said flare apparatus and burning therein.

2. The flare apparatus of claim 1 wherein said means for causing air discharged from said air discharge space to swirl comprises said source of air being tangentially connected to said inner tubular member.

3. The flare apparatus of claim 1 wherein said means for causing air discharged from said air discharge space to swirl comprises at least one air deflector attached within said air discharge space.

4. The flare apparatus of claim 3 wherein said air deflector is a fixed slanted vane attached within said air discharge space.

5. The flare apparatus of claim 1 wherein said source of air is an atmospheric air blower.

6. The flare apparatus of claim 1 which further comprises at least one pilot gas burner assembly attached to said outer tubular member.

7. An improved flare apparatus having a long service life for discharging and burning a flammable gas and air in the atmosphere comprising:

an outer tubular member having a discharge end and an inlet end, said inlet end being connected to a source of air;

a first inner tubular member having a discharge end and an opposite end positioned within at least the discharge end portion of said outer tubular member whereby an annular air discharge space is provided between said outer tubular member and said first inner tubular member;

a second inner tubular member positioned within said first inner tubular member having a discharge end and an opposite end whereby an annular flammable gas discharge space is provided between said first and second inner tubular members;

said flammable gas discharge space between said first and second inner tubular members having an annular width in the range of from about 0.25 inch to about 3.5 inches and being sealingly connected to a source of flammable gas;

means attached to said annular air discharge space for causing air discharged therefrom to swirl thereby preventing said air from mixing with said flammable gas inside said flare apparatus and burning therein; and the ratio of the annular width of said annular air discharge space to the annular width of said annular flammable gas discharge space being in the range of from about 1 to about 10.

8. The flare apparatus of claim 7 wherein the ratio of the annular width of said annular air discharge space to the annular width of said annular flammable gas discharge space is in the range of from about 1 to about 4.

9. The flare apparatus of claim 7 wherein said means for causing air discharged from said annular air discharge space to swirl are comprised of one or more fixed slanted vanes attached in spaced relationship within said annular air discharge space.

10. The flare apparatus of claim 7 which further comprises at least two additional tubular members positioned within said outer tubular member which are spaced from each other and from said outer tubular member and said first and second inner tubular members whereby at least one additional annular flammable gas discharge space sealingly connected to said source of flammable gas and at least one additional annular air discharge space are provided.

11. The flare apparatus of claim 7 wherein said inlet end of said outer tubular member is sealingly connected to the top end of a flare stack.

12. The flare apparatus of claim 11 wherein said source of flammable gas is a flammable gas conduit for conducting said flammable gas through said flare stack to said flare apparatus.

13. The flare apparatus of claim 11 wherein said source of air is an atmospheric air blower sealingly connected to said flare stack.

14. The flare apparatus of claim 7 which further comprises at least one pilot gas burner assembly attached to said outer tubular member.

15. The flare apparatus of claim 7 wherein said annular air discharge space is of a cross-sectional area such that the air to be burned has a discharge velocity therefrom in the range of from about 90 to about 250 feet per second.

16. An improved flare apparatus having a long service life for discharging and burning a flammable gas and air in the atmosphere comprising:

an outer tubular member having a discharge end and an inlet end, said inlet end being connected to a source of said air;

a first inner tubular member having a discharge end and an opposite end positioned within at least the discharge end portion of said outer tubular member whereby a first annular air discharge space is provided between said outer tubular member and said first inner tubular member;

a second inner tubular member positioned within said first inner tubular member having a discharge end and an opposite end whereby an annular flammable gas discharge space is provided between said first and second inner tubular members and a second annular air discharge space is provided within said second inner tubular member;

said flammable gas discharge space between said first and second inner tubular members having an annular width in the range of from about 0.25 inch to about 3.5 inches and being sealingly connected to a source of flammable gas;

said second annular air discharge space within said second inner tubular member being communicated with said source of air connected to said inlet end of said outer tubular member;

means attached to at least one of said first or second annular air discharge spaces for causing air discharged therefrom to swirl thereby preventing air from mixing with said flammable gas in said flare apparatus and burning therein; and the ratio of the annular widths of the annular air discharge spaces to the annular width of the annular flammable gas discharge space being in the range of from about 1 to about 10.

17. The flare apparatus of claim 16 wherein the ratio of the annular widths of the annular air discharge spaces to the annular width of the annular flammable gas discharge space is in the range of from about 1 to about 4.

18. The flare apparatus of claim 16 wherein said means for causing air discharged from said annular discharge space to swirl are comprised of a plurality of fixed slanted vanes attached in spaced relationship around and within said annular air discharge space.

19. The flare apparatus of claim 16 which further comprises at least two additional tubular members positioned within said outer tubular member which are spaced from each other and from said outer tubular member and said first and second inner tubular members whereby at least one additional annular flammable gas discharge space sealingly connected to said source of flammable gas and at least one additional annular air discharge space are provided.

20. The flare apparatus of claim 16 wherein said inlet end of said outer tubular member is sealingly connected to the top end of a flare stack.

21. The flare apparatus of claim 20 wherein said source of flammable gas is a flammable gas conduit for conducting said flammable gas through said flare stack to said flare apparatus.

22. The flare apparatus of claim 20 wherein said source of air is an atmospheric air blower sealingly connected to said flare stack.

23. The flare apparatus of claim 16 which further comprises at least one pilot gas burner assembly attached to said outer tubular member.

24. The flare apparatus of claim 16 wherein said first annular air discharge space is of a cross-sectional area such that the air to be burned has a discharge velocity therefrom in the range of from about 90 to about 250 feet per second.

25. The flare apparatus of claim 16 wherein said second annular air discharge space is of a cross-sectional area such that the air to be burned has a discharge velocity therefrom in the range of from about 90 to about 250 feet per second.

26. A method of flaring a mixture of flammable gas and air without internal burning and premature failure of the flare apparatus utilized comprising the steps of:

(a) discharging said air from said flare apparatus into the atmosphere in a swirling annular pattern; and (b) discharging said flammable gas from said flare apparatus into the atmosphere in an annular straight out pattern having an annular width in the range of from about 0.25 inch to about 3.5 inches coaxial with and immediately adjacent to said swirled pattern of said discharged air whereby said air mixes with said flammable gas and the mixture is burned outside of said flare apparatus.

27. The method of claim 26 wherein the ratio of the annular width of the discharged air annular pattern to the annular width of the discharged flammable gas annular pattern is in the range of from about 1 to about 10.

28. The method of claim 26 wherein the ratio of the annular width of the discharged air annular pattern to the annular width of the discharged flammable gas annular pattern is in the range of from about 1 to about 4.

29. The method of claim 26 which further comprises the steps of discharging a first part of said air in accordance with step (a) and discharging a second part of said air in an annular pattern whereby at least a portion of said air is swirled immediately adjacent to said discharged flammable gas on the opposite side thereof from said first part of said air.

30. The method of claim 26 wherein said air is discharged in accordance with step (a) at a velocity in the range of from about 90 to about 250 feet per second.

31. The method of claim 29 wherein said first part of said air is discharged in accordance with step (a) at a velocity in the range of from about 90 to about 250 feet per second and said second part of said air is discharged at a velocity in the range of from about 90 to about 250 feet per second.

32. A method of flaring a mixture of flammable gas and air without internal burning and premature failure of the flare apparatus utilized comprising the steps of:

(a) discharging a first part of said air from said flare apparatus into the atmosphere in an annular swirling pattern wherein at least a portion of said first part of said air is swirled;

(b) discharging a first part of said flammable gas from said flare apparatus into the atmosphere in an annular straight out pattern coaxially with and immediately adjacent to said discharged first part of said air whereby said first part of said air mixes with said discharged first part of said flammable gas and the mixture is burned outside of said flare apparatus;

(c) discharging a second part of said air from said flare apparatus into the atmosphere in an annular swirling pattern immediately adjacent to said discharged first part of said flammable gas on the opposite side thereof from said discharged first part of said air wherein at least a portion of said second part of said air is swirled; and (d) discharging a second part of said flammable gas from said flare apparatus into the atmosphere in an annular straight out pattern immediately adjacent to said discharged second part of said air on the opposite side thereof from said discharged first part of said flammable gas whereby said second part of said air mixes with said second part of said flammable gas and the mixture is burned outside of said flare apparatus.

33. The method of claim 32 which further comprises the step of discharging a third part of said air from said flare apparatus into the atmosphere in an annular swirling pattern immediately adjacent to said second part of said flammable gas discharged in accordance with step (d) on the opposite side thereof from said second part of said air discharged in accordance with step (c).

34. The method of claim 32 wherein said first part of said air is discharged in accordance with step (a) at a velocity in the range of from about 90 to about 250 feet per second.

35. The method of claim 32 wherein said second part of said air is discharged in accordance with step (c) at a velocity in the range of from about 90 to about 250 feet per second.

36. The method of claim 33 wherein said third part of said air is discharged at a velocity in the range of from about 90 to about 250 feet per second.

37. A method of flaring a mixture of flammable gas and air without internal burning and premature failure of the flare apparatus utilized comprising the steps of:

(a) discharging a first part of said air from said flare apparatus into the atmosphere in an annular pattern;

(b) discharging a first part of said flammable gas from said flare apparatus into the atmosphere in an annular straight out pattern coaxially with and immediately adjacent to said discharged first part of said air;

(c) discharging a second part of said air from said flare apparatus into the atmosphere in an annular pattern immediately adjacent to said discharged first part of said flammable gas on the opposite side thereof from said discharged first part of said air;

(d) discharging a second part of said flammable gas from said flare apparatus into the atmosphere in an annular straight out pattern immediately adjacent to said discharged second part of said air on the opposite side thereof from said discharged first part of said flammable gas;

(e) discharging a third part of said air from said flare apparatus into the atmosphere in an annular pattern immediately adjacent to said discharged second part of said flammable gas on the opposite side thereof from said discharged second part of said air; and (f) at least portions of one or more of said discharged first, second and third parts of said air being discharged in annular swirling patterns immediately adjacent to at least one side of each of said discharged first and second parts of said flammable gas whereby said first, second and third parts of said air mix with said first and second parts of said flammable gas and the mixture is burned outside of said flare apparatus.

38. The method of claim 37 wherein said first part of said air is discharged in accordance with step (a) at a velocity in the range of from about 90 to about 250 feet per second.

39. The method of claim 37 wherein said second part of said air is discharged in accordance with step (c) at a velocity in the range of from about 90 to about 250 feet per second.

40. The method of claim 37 wherein said third part of said air is discharged in accordance with step (e) at a velocity in the range of from about 90 to about 250 feet per second.

* * * * *